US011680221B2

(12) United States Patent
Matsuda et al.

(10) Patent No.: US 11,680,221 B2
(45) Date of Patent: *Jun. 20, 2023

(54) LUBRICATING OIL COMPOSITION FOR INTERNAL COMBUSTION ENGINE

(71) Applicant: ENEOS Corporation, Tokyo (JP)

(72) Inventors: Hiromitsu Matsuda, Toyko (JP); Koji Hoshino, Tokyo (JP)

(73) Assignee: ENEOS CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/614,427

(22) PCT Filed: May 18, 2018

(86) PCT No.: PCT/JP2018/019340

§ 371 (c)(1),
(2) Date: Nov. 18, 2019

(87) PCT Pub. No.: WO2018/212340

PCT Pub. Date: Nov. 22, 2018

(65) Prior Publication Data

US 2020/0181524 A1 Jun. 11, 2020

(30) Foreign Application Priority Data

May 19, 2017 (JP) ..... JP2017-100076

(51) Int. Cl.

| | |
|---|---|
| ***C10M 101/00*** | (2006.01) |
| ***C10M 141/12*** | (2006.01) |
| ***C10M 101/02*** | (2006.01) |
| ***C10M 129/54*** | (2006.01) |
| ***C10M 135/10*** | (2006.01) |
| ***C10M 139/00*** | (2006.01) |
| ***C10M 145/14*** | (2006.01) |
| ***C10M 169/04*** | (2006.01) |
| *C10N 30/00* | (2006.01) |
| *C10N 20/04* | (2006.01) |
| *C10N 30/02* | (2006.01) |
| *C10N 30/04* | (2006.01) |
| *C10N 30/08* | (2006.01) |
| *C10N 40/25* | (2006.01) |

(52) U.S. Cl.

CPC ..... *C10M 141/12* (2013.01); *C10M 101/02* (2013.01); *C10M 129/54* (2013.01); *C10M 135/10* (2013.01); *C10M 139/00* (2013.01); *C10M 145/14* (2013.01); *C10M 169/044* (2013.01); *C10M 2207/262* (2013.01); *C10M 2209/084* (2013.01); *C10M 2227/09* (2013.01); *C10M 2290/02* (2013.01); *C10M 2290/04* (2013.01); *C10N 2020/04* (2013.01); *C10N 2030/02* (2013.01); *C10N 2030/04* (2013.01); *C10N 2030/08* (2013.01); *C10N 2030/74* (2020.05); *C10N 2040/25* (2013.01)

(58) Field of Classification Search

CPC ..... C10M 101/00; C10N 2030/02

See application file for complete search history.

(56) References Cited

U.S. PATENT DOCUMENTS

| | | | | |
|---|---|---|---|---|
| 5,739,088 | A * | 4/1998 | Inoue | C10M 159/22 508/156 |
| 11,168,281 | B2 * | 11/2021 | Matsuda | C10M 139/00 |
| 2011/0218131 | A1 | 9/2011 | Tsujimoto et al. | |
| 2011/0237477 | A1 | 9/2011 | Tagawa et al. | |
| 2012/0129741 | A1 * | 5/2012 | Dunning | C10M 107/02 508/110 |
| 2015/0099678 | A1 | 4/2015 | Abi-Karam et al. | |
| 2015/0218482 | A1 * | 8/2015 | Ito | C10M 169/048 508/409 |
| 2016/0097017 | A1 | 4/2016 | Eisenberg et al. | |
| 2017/0121627 | A1 | 5/2017 | Ishikawa et al. | |
| 2017/0204348 | A1 | 7/2017 | Tamura | |
| 2017/0369808 | A1 | 12/2017 | Kusuhara | |
| 2018/0023026 | A1 | 1/2018 | Kusuhara | |
| 2018/0072962 | A1 | 3/2018 | Wada et al. | |
| 2018/0100120 | A1 | 4/2018 | Flores-Torres et al. | |
| 2019/0144775 | A1 | 5/2019 | Mosier et al. | |
| 2020/0080018 | A1 | 3/2020 | Matsuda et al. | |

FOREIGN PATENT DOCUMENTS

| | | |
|---|---|---|
| CN | 102239241 | 11/2011 |
| CN | 102803446 | 11/2012 |

(Continued)

OTHER PUBLICATIONS

Fujimoto et al., "Engine oil Development for Preventing Pre-Ignition in Turbocharged Gasoline Engine", SAE Int. J. Fuels Lubr. 7(3), 2014, doi: 10.4271/2014-01-2785, pp. 869-874.

(Continued)

*Primary Examiner* — Ellen M McAvoy

*Assistant Examiner* — Ming Cheung Po

(74) *Attorney, Agent, or Firm* — Greenblum & Bernstein, P.L.C.

(57) ABSTRACT

A lubricating oil composition for an internal combustion engine, the composition including: a lubricating base oil comprising at least one mineral base oil or at least one synthetic base oil or any combination thereof, the lubricating base oil having a kinematic viscosity at 100° C. of 4.0 to 4.5 $mm^2/s$ and a NOACK evaporation loss at 250° C. of no more than 15 mass %; (A) a calcium-containing metallic detergent in an amount of no less than 1000 mass ppm and less than 2000 mass ppm in terms of calcium on the basis of the total mass of the composition; and optionally (C) a viscosity index improver in an amount of less than 1 mass % on the basis of the total mass of the composition.

9 Claims, No Drawings

(56) References Cited

FOREIGN PATENT DOCUMENTS

| | | | | |
|---|---|---|---|---|
| CN | 106459814 | | 2/2017 | |
| JP | 03-263496 | | 11/1991 | |
| JP | 2003-155492 | | 5/2003 | |
| JP | 2017-226793 | A | 12/2017 | |
| WO | 2015/171978 | | 11/2015 | |
| WO | WO-2015171978 | A1 * | 11/2015 | ..... C10M 129/10 |
| WO | 2016/129465 | | 8/2016 | |
| WO | WO-2016129465 | A1 * | 8/2016 | ..... C10M 133/06 |
| WO | 2016/151467 | | 9/2016 | |
| WO | 2016/159006 | | 10/2016 | |
| WO | 2016/159216 | | 10/2016 | |

OTHER PUBLICATIONS

ISR issued in WIPO Patent Application No. PCT/JP2018/019340, dated Aug. 14, 2018, English translation.
IPRP issued in WIPO Patent Application No. PCT/JP2018/019340, dated Nov. 19, 2019, English translation.
ISR of International Patent Application PCT/JP2018/019338, dated Aug. 14, 2018, translation.
IPRP of International Patent Application PCT/JP2018/019338, dated Nov. 19, 2019, translation.
Regular Office Action issued in U.S. Appl. No. 16/614,437, filed Feb. 19, 2021.
Notice of Allowance issued in U.S. Appl. No. 16/614,437, filed Jul. 9, 2021.

* cited by examiner

LUBRICATING OIL COMPOSITION FOR INTERNAL COMBUSTION ENGINE

TECHNICAL FIELD

The present invention relates to a lubricating oil composition for an internal combustion engine.

BACKGROUND ART

Conventionally, lubricating oils are used for internal combustion engines, transmissions, and other machineries for their smooth operation. Specifically, lubricating oils for internal combustion engines (engine oils) are required to have increasingly higher performance due to increasingly higher performance, increasingly higher power, and increasingly severe operation conditions, etc. of internal combustion engines. Therefore, various additives such as anti-wear agents, metallic detergents, ashless dispersants, and antioxidants are incorporated in conventional engine oils in order to satisfy the above required performance. Recently, much higher fuel efficiency has been required of lubricating oils, and application of high viscosity index base oils and various friction modifiers is being considered.

CITATION LIST

Patent Literature

Patent Literature 1: JP 2003-155492 A
Patent Literature 2: WO 2016/159006 A1

Non-Patent Literature

Non-Patent Literature 1: Fujimoto, K.; Yamashita, M.; Hirano, S.; Kato, K. et al., "Engine Oil Development for Preventing Pre-Ignition in Turbocharged Gasoline Engine", SAE Int. J. Fuels Lubr. 7(3): 2014, doi: 10.4271/2014-01-2785

SUMMARY OF INVENTION

Technical Problem

However, conventional lubricating oils are not necessarily enough in terms of fuel efficiency.

Examples of commonly known techniques for improving fuel efficiency include reducing a kinematic viscosity and increasing a viscosity index of a lubricating oil (a multigrade oil comprising a low viscosity base oil and a viscosity index improver in combination), and incorporating a friction reducing agent. When the viscosity of a lubricating oil is reduced, lubricating performance under severe lubricating conditions (under high temperature and high shear conditions) deteriorates due to the decrease of the viscosity of the lubricating oil or a base oil constituting the lubricating oil, which may lead to troubles such as wear, seizure, and fatigue failure, and an increased evaporation loss. An ashless or molybdenum friction modifier is known as a friction reducing agent. However, a fuel efficient lubricating oil which outperforms such a common lubricating oil containing a friction reducing agent is demanded.

It is necessary to make HTHS viscosity at 150° C. high ("HTHS viscosity" is also called "high temperature high shear viscosity") so as to prevent troubles due to a decreased viscosity and to maintain durability. It is also necessary to make shear stability high so as to prevent viscosity decrease due to shear. It is advantageous to decrease kinematic viscosity at 40° C., kinematic viscosity at 100° C., and HTHS viscosity at 100° C. while maintaining a HTHS viscosity at 150° C. of a certain level for further improving fuel efficiency while maintaining other performances for practical use. However, it is very difficult for conventional lubricating oils to satisfy all these requirements.

Moreover, recently, it has been proposed to replace a conventional naturally aspirated engine with an engine having a less displacement and equipped with a turbocharger (turbocharged downsized engine), so as to improve fuel efficiency of an automobile engine, especially of an automobile gasoline engine. Turbocharged downsized engines make it possible to reduce a displacement while maintaining engine power, and thus to improve fuel efficiency, owning to the turbocharger. Disadvantageously, turbocharged downsized engines may suffer a phenomenon that ignition occurs in a cylinder earlier than an expected timing (LSPI: Low Speed Pre-Ignition), when the torque is increased at a low rotation speed. LSPI leads to increase of energy loss, and thus to restriction on fuel efficiency improvement and low-speed torque improvement. Engine oils are suspected to have an influence on occurrence of LSPI.

So as to suppress LSPI, one may think of reducing a calcium detergent. As regards fuel efficiency, it is a common means for improving fuel efficiency to increase the amount of a molybdenum friction modifier. A lubricating oil composition of such a formulation, though, tends to suffer inferior detergency.

For improving fuel efficiency, it is also effective to decrease viscosity of a base oil as described above. A less viscous base oil is, though, tends to have more volatility. Thus a fuel-efficient lubricating oil composition comprising a less viscous base oil tends to suffer increased consumption of the oil.

An object of the present invention is to provide a lubricating oil composition for an internal combustion engine which can improve fuel efficiency, LSPI suppression, oil consumption suppression, and detergency in a well-balanced manner.

Solution to Problem

The present invention encompasses the following aspects of [1] to [9]:

[1] a lubricating oil composition for an internal combustion engine, the composition comprising: a lubricating base oil comprising at least one mineral base oil or at least one synthetic base oil or any combination thereof, the lubricating base oil having a kinematic viscosity at 100° C. of 4.0 to 4.5 $mm^2/s$ and a NOACK evaporation loss at 250° C. of no more than 15 mass %; (A) a calcium borate-containing metallic detergent in an amount of no less than 1000 mass ppm and less than 2000 mass ppm in terms of calcium on the basis of the total mass of the composition; and optionally (C) a viscosity index improver in an amount of less than 1.0 mass % on the basis of the total mass of the composition;

[2] the lubricating oil composition according to [1], further comprising: (B) a magnesium-containing metallic detergent;

[3] the lubricating oil composition according to [1] or [2], the component (C) comprising: (C1) a poly(meth)acrylate viscosity index improver in an amount of no less than 95 mass % on the basis of the total mass of the component (C), the component (C1) having a weight average molecular weight of no less than 100,000;

[4] the lubricating oil composition according to any one of [1] to [3], wherein the composition does not comprise the component (C);

[5] the lubricating oil composition according to any one of [1] to [4], further comprising: (D) a friction modifier, the component (D) comprising a molybdenum friction modifier;

[6] the lubricating oil composition according to any one of [1] to [5], wherein the lubricating base oil is at least one synthetic base oil;

[7] the lubricating oil composition according to any one of [1] to [6], wherein the composition has a HTHS viscosity at 150° C. of 1.7 to 2.0 mPa·s;

[8] the lubricating oil composition according to any one of [1] to [7], wherein the composition has a HTHS viscosity at 100° C. of 3.5 to 4.4 mPa·s; and

[9] the lubricating oil composition according to any one of [1] to [8], wherein the composition has a NOACK evaporation loss at 250° C. of no more than 15 mass %.

In the present description, "kinematic viscosity at 100° C." means kinematic viscosity at 100° C. specified in ASTM D-445, "HTHS viscosity at 150° C." means high temperature high shear viscosity at 150° C. specified in ASTM D4683, "HTHS viscosity at 100° C." means high temperature high shear viscosity at 100° C. specified in ASTM D4683, and "NOACK evaporation loss at 250° C." is an evaporation loss of the lubricating oil at 250° C. which is measured conforming to ASTM D 5800.

Advantageous Effects of Invention

The lubricating oil composition for an internal combustion engine of the present invention can improve fuel efficiency, LSPI suppression, oil consumption suppression, and detergency in a well-balanced manner.

DESCRIPTION OF EMBODIMENTS

The present invention will be described hereinafter. Expression "A to B" concerning numeral values A and B means "no less than A and no more than B" unless otherwise specified. In such expression, if a unit is added only to the numeral value B, the unit is applied to the numeral value A as well. A word "or" means a logical sum unless otherwise specified. In the present description, "alkaline earth metal" encompasses magnesium.

<Lubricating Base Oil>

A lubricating base oil comprising at least one mineral base oil or at least one synthetic base oil or any combination thereof, the lubricating base oil having a kinematic viscosity at 100° C. of 4.0 to 4.5 $mm^2/s$ and a NOACK evaporation loss at 250° C. of no more than 15 mass % (hereinafter may be referred to as "lubricating base oil according to the present embodiment") is used as the lubricating base oil. At least one Group II base oil of API base stock categories, or at least one Group III base oil of API base stock categories, or any combination thereof may be preferably used as the mineral base oil. At least one Group IV base oil of API base stock categories may be preferably used as the synthetic base oil.

Examples of the mineral base oil include a paraffinic mineral oil, a normal-paraffinic base oil, an isoparaffinic base oil, and any mixtures thereof, having a kinematic viscosity at 100° C. of 4.0 to 4.5 $mm^2/s$, and a NOACK evaporation loss at 250° C. of no more than 15 mass %, which are obtained by refining lubricating oil fractions that are obtained by distillation under atmospheric pressure and/or distillation under reduced pressure of crude oil, through a refining process including solvent deasphalting, solvent extraction, hydrocracking, solvent dewaxing, catalytic dewaxing, hydrorefining, sulfuric acid washing, or white clay treatment, etc., or any combination thereof.

Preferred examples of the mineral base oil include base oils obtained by (i) refining a raw material base oil of any one of the following (1) to (8) and/or lubricating oil fractions recovered from the raw material base oil, by a predetermined refining method, and then (ii) recovering lubricating oil fractions therefrom:

(1) a distillate obtained by atmospheric distillation of a paraffin base crude oil and/or a mixed base crude oil;

(2) a distillate obtained by vacuum distillation of residue of atmospheric distillation of a paraffin base crude oil and/or a mixed base crude oil (WVGO);

(3) a wax obtained through a lubricating oil dewaxing step (slack wax etc.) and/or a synthetic wax obtained through a gas-to-liquid (GTL) process or the like (Fischer-Tropsch wax, GTL wax, etc.);

(4) a mixed oil of at least one selected from the base oils (1) to (3), and/or a mild hydrocracked oil of the mixed oil;

(5) a mixed oil of at least two selected from the base oils (1) to (4);

(6) a deasphalted oil of the base oil (1), (2), (3), (4) or (5) (DAO);

(7) a mild hydrocracked oil of the base oil (6) (MHC); and (8) a mixed oil of at least two selected from the base oils (1) to (7).

Preferred examples of the above described predetermined refining method include: hydrorefining such as hydrocracking and hydrofinishing; solvent refining such as furfural solvent extraction; dewaxing such as solvent dewaxing and catalytic dewaxing; white clay treatment using acid white clay, activated white clay, etc.; and chemical (acid or alkali) washing such as sulfuric acid washing and caustic soda washing. One of these refining methods may be used alone, or at least two of them may be used in combination. When at least two of the refining methods are used in combination, the order of using them is not specifically restricted, and may be properly determined.

The following base oil (9) or (10) is especially preferable as the mineral base oil. The base oils (9) and (10) are obtained through a predetermined process on a base oil selected from the base oils (1) to (8), or on lubricating oil fractions recovered from the selected base oil:

(9) a hydrocracked base oil obtained by: hydrocracking a base oil selected from the base oils (1) to (8) or lubricating oil fractions recovered from the selected base oil; dewaxing the hydrocracked product or lubricating oil fractions recovered therefrom by distillation or the like, through a dewaxing process such as solvent dewaxing and catalytic dewaxing; and optionally further distilling the dewaxed product; and

(10) a hydroisomerized base oil obtained by: hydroisomerizing a base oil selected from the base oils (1) to (8) or lubricating oil fractions recovered from the selected base oil; carrying out a dewaxing process such as solvent dewaxing and catalytic dewaxing on the hydroisomerized product or lubricating oil fractions recovered therefrom by distillation or the like; and optionally further distilling the dewaxed product. A base oil produced via catalytic dewaxing as the dewaxing process is preferable.

When obtaining the lubricating base oil (9) or (10), a solvent refining process and/or hydrofinishing process may be further performed at a proper stage if necessary.

A catalyst used for the above described hydrocracking or hydroisomerization is not specifically restricted. Preferred examples thereof include a hydrocracking catalyst including metal having a hydrogenating ability (such as at least one metal of the group VIa and group VIII of the periodic table) supported on a catalyst support, the catalyst support including at least one composite oxide having a cracking activity (for example, silica-alumina, alumina-boria and silica-zirconia) and the catalyst support optionally further including a binder binding the at least one composite oxide; and a hydroisomerization catalyst including metal having a hydrogenation ability including at least one group VIII metal, the metal being supported on a catalyst support, the catalyst support including a zeolite (such as ZSM-5, zeolite beta, and SAPO-11). The hydrocracking catalyst and the hydroisomerization catalyst may be used in combination by stacking, mixing, or the like.

Reaction conditions upon hydrocracking or hydroisomerization are not specifically restricted. Preferably, the hydrogen partial pressure is 0.1 to 20 MPa, the average reaction temperature is 150 to 450° C., LHSV is 0.1 to 3.0 $hr^{-1}$, and the hydrogen/oil ratio is 50 to 20000 scf/b.

The kinematic viscosity of the lubricating base oil at 100° C. is 4.0 to 4.5 $mm^2/s$. The kinematic viscosity of the lubricating base oil at 100° C. of no less than 4.0 $mm^2/s$ offers enough oil film formation at a lubricating point and thus improved lubricity, and makes it possible to suppress the evaporation loss of the lubricating oil composition. The kinematic viscosity of the lubricating base oil at 100° C. of no more than 4.5 $mm^2/s$ offers improved fuel efficiency.

The kinematic viscosity of the lubricating base oil at 40° C. is preferably no more than 40 $mm^2/s$, more preferably no more than 30 $mm^2/s$, further preferably no more than 25 $mm^2/s$, especially preferably no more than 22 $mm^2/s$, most preferably no more than 20 $mm^2/s$; preferably no less than 10 $mm^2/s$, more preferably no less than 12 $mm^2/s$, further preferably no less than 14 $mm^2/s$, and especially preferably no less than 16 $mm^2/s$. The kinematic viscosity of the lubricating base oil at 40° C. of this upper limit or below makes it possible to further improve low-temperature viscosity characteristics and fuel efficiency of the lubricating oil composition. The kinematic viscosity of the lubricating base oil at 40° C. of this lower limit or over offers enough oil film formation at a lubricating point and thus further improved lubricity, and offers further reduced evaporation loss of the lubricating oil composition.

In this description, kinematic viscosity at 40° C. means kinematic viscosity at 40° C. defined in ASTM D-445.

The viscosity index of the lubricating base oil is preferably no less than 100, more preferably no less than 105, further preferably no less than 110, especially preferably no less than 115, and most preferably no less than 120. The viscosity index of this lower limit or over makes it possible to further improve viscosity-temperature characteristics, thermal and oxidation stability, and evaporation prevention of the lubricating oil composition, and easy to reduce friction coefficients, and makes it easy to improve anti-wear performance. Viscosity index in this description means viscosity index measured conforming to JIS K 2283-1993.

The NOACK evaporation loss of the lubricating base oil at 250° C. is no more than 15 mass %. The NOACK evaporation loss here is the evaporation loss of the lubricating oil measured conforming to ASTM D 5800. The lower limit of the NOACK evaporation loss of the lubricating base oil at 250° C. is not specifically restricted, and normally no less than 5 mass %.

The pour point of the lubricating base oil is preferably no more than −10° C., more preferably no more than −12.5° C., and further preferably no more than −15° C. The pour point of more than this upper limit tends to deteriorate low-temperature fluidity of the entire lubricating oil composition. Pour point in this description means pour point measured conforming to JIS K 2269-1987.

The sulfur content in the lubricating base oil depends on the sulfur content in its raw material. For example, in a case where a raw material that is substantially sulfur free, such as a synthetic wax component obtained through Fischer-Tropsch reaction or the like, is used, a lubricating base oil that is substantially sulfur free can be obtained. In a case where a raw material containing sulfur, such as slack wax obtained through the process of refining the lubricating base oil, and microwax obtained through a wax refining process, is used, the sulfur content in the obtained lubricating base oil is usually no less than 100 mass ppm. In view of further improvement of the thermal and oxidation stability and the decrease of the sulfur content of the lubricating oil composition, the sulfur content of the lubricating base oil is preferably no more than 100 mass ppm, more preferably no more than 50 mass ppm, further preferably no more than 10 mass ppm, and especially preferably no more than 5 mass ppm.

The nitrogen content in the lubricating base oil is preferably no more than 10 mass ppm, more preferably no more than 5 mass ppm, and further preferably no more than 3 mass ppm. The nitrogen content of more than 10 mass ppm tends to lead to deteriorated thermal and oxidation stability. Nitrogen content in this description means nitrogen content measured conforming to JIS K 2609-1990.

% $C_P$ of the mineral base oil is preferably no less than 70, more preferably no less than 75, usually no more than 99, preferably no more than 95, and more preferably no more than 94. % $C_P$ of the base oil of this lower limit or over makes it easy to improve viscosity-temperature characteristics, thermal and oxidation stability, and friction properties, and makes it easy to improve effect of an additive when the additive is incorporated to the base oil. % $C_P$ of the base oil of this upper limit or below makes it easy to improve solubility of an additive.

% $C_A$ of the mineral base oil is preferably no more than 2, more preferably no more than 1, further preferably no more than 0.8, and especially preferably no more than 0.5. % $C_A$ of the base oil of this upper limit or below makes it easy to improve viscosity-temperature characteristics, thermal and oxidation stability, and fuel efficiency.

% $C_N$ of the mineral base oil is preferably no more than 30, more preferably no more than 25, preferably no less than 1, and more preferably no less than 4. % $C_N$ of the base oil of this upper limit or below makes it easy to improve viscosity-temperature characteristics, thermal and oxidation stability, and friction properties. % $C_N$ of the base oil of this lower limit or over makes it easy to improve solubility of an additive.

In this description, % $C_P$, % $C_N$ and % $C_A$ mean percentage of the paraffinic carbons to the total carbons, percentage of the naphthenic carbons to the total carbons, and percentage of the aromatic carbons to the total carbons, respectively, obtained by the method conforming to ASTM D 3238-85 (ring analysis by n-d-M method). That is, the above described preferred ranges of % $C_P$, % $C_N$, and % $C_A$ are based on values obtained according to the above method. For example, the value of % $C_N$ obtained according to the above method can be more than 0 even if the lubricating base oil does not include the naphthene content.

The saturated content in the mineral base oil is preferably no less than 90 mass %, preferably no less than 95 mass %, and more preferably no less than 99 mass %, on the basis of the total mass of the base oil. The saturated content of this lower limit or over makes it possible to improve viscosity-temperature characteristics, and thermal and oxidation stability. In this description, saturated content represents a value measured conforming to ASTM D 2007-93.

Any similar method according to which the same result is obtained may be used for a separation method for the saturated content. Examples thereof include the method specified in the above ASTM D 2007-93, the method specified in ASTM D 2425-93, the method specified in ASTM D 2549-91, methods using high performance liquid chromatography (HPLC), and improved methods of them.

The aromatic content in the mineral base oil is preferably no more than 10 mass %, more preferably no more than 5 mass %, further preferably no more than 4 mass %, especially preferably no more than 3 mass %, and most preferably no more than 2 mass %, may be 0 mass %, and in one embodiment, is no less than 0.1 mass %, on the basis of the total mass of the base oil. The aromatic content of this upper limit or below makes it easy to improve viscosity-temperature characteristics, thermal and oxidation stability and friction properties, and evaporation prevention and low-temperature viscosity characteristics, and makes it easy to improve effect of an additive in a case where the additive is incorporated into the lubricating base oil. The lubricating base oil may contain no aromatic content. The aromatic content of this lower limit or over however makes it possible to further improve solubility of an additive.

In this description, aromatic content represents a value measured conforming to ASTM D 2007-93. Aromatic content usually includes alkylbenzenes, and alkylnaphthalenes; anthracenes, phenanthrenes and alkylated compounds thereof; compounds having four or more fused benzene rings; and aromatic compounds having a heteroatom such as pyridines, quinolines, phenols, and naphthols.

Examples of the synthetic base oil include a poly α-olefin and hydrogenated products thereof, an isobutene oligomer and hydrogenated products thereof, an isoparaffin, an alkylbenzene, an alkylnaphthalene, a diester (such as ditridecyl glutarate, di-2-ethylhexyl adipate, diisodecyl adipate, ditridecyl adipate, and di-2-ethylhexyl sebacate), a polyol ester (such as trimethylolpropane caprylate, trimethylolpropane pelargonate, pentaerythritol 2-ethylhexanoate, and pentaerythritol pelargonate), a polyoxyalkylene glycol, a dialkyl diphenyl ether, a polyphenyl ether, and mixtures thereof; each having a kinematic viscosity at 100° C. of 4.0 to 4.5 $mm^2/s$, and a NOACK evaporation loss at 250° C. of no more than 15 mass %. Among them, a poly α-olefin is preferable. Examples of the poly α-olefin typically include oligomers and co-oligomers of α-olefins having a carbon number of 2-32, preferably 6-16 (such as 1-octene oligomers, decene oligomers, and ethylene-propylene co-oligomers), and hydrogenated products thereof.

A method for producing the poly α-olefin is not specifically restricted. Examples thereof include polymerizing an α-olefin in the presence of a polymerization catalyst such as a catalyst containing a complex of aluminum trichloride or boron trifluoride, and water, an alcohol (such as ethanol, propanol, and butanol), a carboxylic acid or an ester.

The lubricating base oil may comprise one base oil component, and may comprise a plurality of base oil components as long as a kinematic viscosity of the whole of the base oil at 100° C. is 4.0 to 4.5 $mm^2/s$, and a NOACK evaporation loss of the whole of the base oil at 250° C. is no more than 15 mass %.

The content of the lubricating base oil in the lubricating oil composition is usually 75 to 95 mass %, and preferably no less than 85 mass %, on the basis of the total mass of the composition.

<(A), (B): Metallic Detergents>

The lubricating oil composition of the present invention comprises (A) a calcium borate-containing metallic detergent (hereinafter may be referred to as "component (A)") as a metallic detergent. In one preferred embodiment, the lubricating oil composition may comprise, (B) a magnesium-containing metallic detergent (hereinafter may be referred to as "component (B)") as a metallic detergent, in addition to the component (A). Examples of the metallic detergent include a phenate detergent, a sulfonate detergent, and a salicylate detergent. One metallic detergent may be used alone, or two or more metallic detergents may be used in combination.

Preferred examples of the phenate detergent include overbased salts of alkaline earth metal salts of compounds having the structure represented by the following formula (1):

(1)

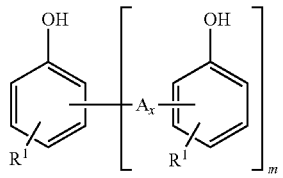

In the formula (1), $R^1$ is a $C_{6-21}$ linear or branched chain, saturated or unsaturated alkyl or alkenyl group; m represents a polymerization degree, and is an integer of 1 to 10; A is a sulfide (—S—) group or a methylene (—$CH_2$—) group; and x is an integer of 1 to 3. $R^1$ may be any combination of at least two different groups.

The carbon number of $R^1$ in the formula (1) is preferably 9 to 18, and more preferably 9 to 15. The carbon number of $R^1$ of this lower limit or over makes it possible to improve solubility in the base oil. The carbon number of $R^1$ of this upper limit or below makes it possible to easily produce the detergent, and makes it possible to improve thermal stability.

The polymerization degree m in the formula (1) is preferably 1 to 4. The polymerization degree m within this range makes it possible to improve thermal stability.

Preferred examples of the sulfonate detergent include alkaline earth metal salts of alkyl aromatic sulfonic acids obtained by sulfonation of alkylaromatics, and basic or overbased salts thereof. The weight-average molecular weight of the alkylaromatics is preferably 400 to 1500, and more preferably 700 to 1300.

Magnesium or calcium is preferable as the alkaline earth metal. Examples of the alkyl aromatic sulfonic acid include what is called petroleum sulfonic acids and synthetic sulfonic acids. Examples of the petroleum sulfonic acid here include sulfonated products of alkylaromatics of lubricating oil fractions derived from mineral oils, and what is called mahogany acid, which is a side product of white oils. Examples of the synthetic sulfonic acid include sulfonated products of alkylbenzenes having a linear or branched alkyl group, obtained by recovering side products in a manufacturing plant of alkylbenzenes, which are raw materials of detergents, or by alkylating benzene with a polyolefin. Other examples of the synthetic sulfonic acid include sulfonated products of alkylnaphthalenes such as dinonylnaphthalene.

A sulfonating agent used when sulfonating these alkylaromatics is not specifically limited, and for example, a fuming sulfuric acid or a sulfuric anhydride may be used.

Preferred examples of the salicylate detergent include metal salicylates, and basic or overbased salts thereof. Preferred examples of the metal salicylate include compounds represented by the following formula (2):

(2)

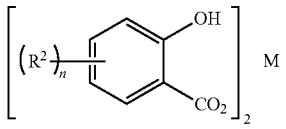

In the formula (2), $R^2$ each independently represents a $C_{14-30}$ alkyl or alkenyl group, M is an alkaline earth metal, and n is 1 or 2. M is preferably calcium or, magnesium, and n is preferably 1. When n is 2, $R^2$ may be any combination of different groups.

One preferred embodiment of the salicylate detergent is an alkaline earth metal salicylate of the formula (2) wherein n is 1, or a basic or overbased salt thereof.

A method for producing the alkaline earth metal salicylate is not specifically restricted, and a known method for producing monoalkylsalicylates or the like may be used. For example, the alkaline earth metal salicylate can be obtained by: making a metal base such as an oxide and hydroxide of an alkaline earth metal react with monoalkylsalicylic acid obtained by alkylating a phenol as starting material with an olefin, and then carboxylating the resultant product with carbonic acid gas or the like, monoalkylsalicylic acid obtained by alkylating a salicylic acid as starting material with an equivalent of the olefin, or the like; or once converting the above monoalkylsalicylic acid or the like to an alkali metal salt such as a sodium salt and a potassium salt, and then performing transmetallation with an alkaline earth metal salt; or the like.

Examples of the component (A) include a calcium borate-containing calcium phenate detergent, a calcium borate-containing calcium sulfonate detergent, a calcium borate-containing calcium salicylate detergent, and any combination thereof. The component (A) preferably contains at least an overbased calcium salicylate detergent, is preferably calcium borate-overbased, and especially preferably contains a calcium borate-overbased calcium salicylate detergent.

Examples of the component (B) include a magnesium phenate detergent, a magnesium sulfonate detergent, a magnesium salicylate detergent, and any combination thereof. The component (B) preferably contains an overbased magnesium sulfonate detergent. The component (B) may be either magnesium carbonate-overbased, or magnesium borate-overbased.

A method for obtaining the alkaline earth metal carbonate salt-overbased metallic detergent is not specifically limited. For example, such a metallic detergent can be obtained by reacting a neutral salt of a metallic detergent (such as an alkaline earth metal phenate, an alkaline earth metal sulfonate, and an alkaline earth metal salicylate) with a base of an alkaline earth metal (such as a hydroxide and an oxide of an alkaline earth metal) in the presence of carbonic acid gas.

A method for obtaining the alkaline earth metal borate salt-overbased metallic detergent is not specifically limited. Such a metallic detergent can be obtained by reacting a neutral salt of a metallic detergent (such as an alkaline earth metal phenate, an alkaline earth metal sulfonate, and an alkaline earth metal salicylate) with a base of an alkaline earth metal (such as a hydroxide and an oxide of an alkaline earth metal) in the presence of a boric acid and optionally a borate salt. The boric acid may be orthoboric acid, or condensed boric acid (such as diboric acid, triboric acid, tetraboric acid, and metaboric acid). Calcium salts of these boric acids (when the component (A) is to be obtained), or magnesium salts thereof (when the component (B) is to be obtained) may be preferably used as the borate salt. The borate salt may be a neutral salt, or an acidic salt. As the boric acid and/or borate salt, a single boric acid or borate salt may be used alone, or two or more of them may be used in combination.

Normally, metallic detergents are commercially available as a dilution diluted with a light lubricating base oil, etc. Generally, a metallic detergent whose metal content is 1.0 to 20 mass %, and preferably 2.0 to 16 mass % is used. The total base number of the metallic detergent may be any number, and a metallic detergent having a total base number of no more than 500 mgKOH/g, and preferably 150 to 450 mgKOH/g is normally used. The total base number means base number measured by the perchloric acid method conforming to 7. of "Petroleum products and lubricants—Determination of neutralization number" in JIS K2501 (1992).

The total base number of the component (A) is preferably no less than 150 mgKOH/g, preferably no more than 350 mgKOH/g, more preferably no more than 300 mgKOH/g, and especially preferably no more than 250 mgKOH/g.

The content of the component (A) in the lubricating oil composition is no less than 1000 mass ppm and less than 2000 mass ppm, and more preferably 1000 to 1500 mass ppm, in terms of calcium on the basis of the total mass of the lubricating oil composition. The content of the component (A) in terms of calcium of this lower limit or over makes it easy to enhance LSPI suppression effect as well as makes it possible to keep high detergency in an engine, and offers improved base number retention properties. The content of the component (A) in terms of calcium of less than 2000 mass ppm makes it possible to suppress increase of the ash content in the composition while obtaining LSPI suppression effect.

The total base number of the component (B) is preferably no less than 200 mgKOH/g, more preferably no less than 250 mgKOH/g, especially preferably no less than 300 mgKOH/g, preferably no more than 600 mgKOH/g, more preferably no more than 550 mgKOH/g, and especially preferably no more than 500 mgKOH/g.

The content of the component (B) in the lubricating oil composition is 100 to 1000 mass ppm, preferably no less than 150 mass ppm, more preferably no less than 200 mass ppm, preferably no more than 800 mass ppm, and more preferably no more than 500 mass ppm, in terms of magnesium on the basis of the total mass of the lubricating oil composition. The content in terms of magnesium of this lower limit or over makes it possible to improve engine detergency while suppressing LSPI. The content in terms of magnesium of this upper limit or below makes it possible to suppress increase of friction coefficients.

A soap content of a calcium detergent forms CaO when being incinerated. It is believed that CaO formation when the lubricating oil composition is incinerated in a cylinder leads to an exothermic reaction of ash particles scattered in the cylinder with carbon dioxide in an atmosphere in the cylinder, to work as ignition sources leading to a LSPI phenomenon. The lubricating oil composition comprising the component (A) as a metallic detergent, though, allows calcium borate of the component (A) to capture CaO to form calcium borates of different stoichiometries such as $CaB_2O_4$, $Ca_2B_2O_5$ and $Ca_3(BO_3)_2$, which makes it possible to reduce or suppress CaO formation in ash. This makes it possible to suppress an exothermic reaction of ash particles scattered in a cylinder with carbon dioxide in an atmosphere in the cylinder, and thus makes it possible to suppress a LSPI phenomenon in which the ash particles scattered in the cylinder work as ignition sources.

The molar ratio B/Ca of the total boron content B (unit: mol) of the lubricating oil composition derived from the metallic detergents and the total calcium content Ca (unit: mol) of the lubricating oil composition derived from the metallic detergents is preferably no less than 0.52, and may be, for example, no less than 0.55. The molar ratio B/Ca of this lower limit or over allows sufficient reduction of CaO in the ash which is formed by incineration of the lubricating oil in a cylinder, which makes it possible to effectively suppress LSPI. The molar ratio B/Ca is preferably no more than 2.0, and may be, for example, no more than 1.7. The molar ratio B/Ca of this upper limit or below makes it easy to improve stability of the metallic detergents.

<(C) Viscosity Index Improver>

Preferably, the lubricating oil composition of the present invention optionally comprises (C) a viscosity index improver (hereinafter may be referred to as "component (C)") in an amount of less than 1 mass % on the basis of the total mass of the composition. That is, the content of a viscosity index improver in the lubricating oil composition is preferably 0 mass % to 1 mass % on the basis of the total mass of the composition. Examples of the component (C) include a non-dispersant or dispersant poly(meth)acrylate viscosity index improver, a (meth)acrylate-olefin copolymer, a non-dispersant or dispersant ethylene-α-olefin copolymer or hydrogenated products thereof, polyisobutylene or hydrogenated products thereof, a hydrogenated styrene-diene copolymer, a styrene-maleic anhydride/ester copolymer, and polyalkylstyrene. The content of the component (C) in the lubricating oil composition of less than 1 mass % makes it possible to improve the detergency of the lubricating oil composition. The content of the component (C) is more preferably no more than 0.9 mass %, and especially preferably no more than 0.8 mass %.

When the lubricating oil composition comprises the component (C), the component (C) preferably comprises: (C1) a poly(meth)acrylate viscosity index improver having a weight average molecular weight of no less than 100,000 (hereinafter may be referred to as "component (C1)"). The content of the component (C1) in the component (C) is preferably no less than 95 mass %, and may be 100 mass %, on the basis of the total mass of the component (C).

The weight average molecular weight (Mw) of the component (C1) is no less than 100,000, preferably no less than 200,000, preferably no more than 1,000,000, more preferably no more than 700,000, and further preferably no more than 500,000. The weight average molecular weight of this lower limit or over makes it possible to enhance the viscosity index improvement effect when the component (C1) is dissolved in the lubricating base oil, and to further improve fuel efficiency and low-temperature viscosity characteristics, and makes it easy to lower the cost. The weight average molecular weight of this upper limit or below makes it possible to suppress excessive viscosity increase effect, which makes it possible to further improve fuel efficiency and low-temperature viscosity characteristics, and makes it possible to improve shear stability, solubility in the lubricating base oil, and storage stability.

The component (C1) preferably comprises a poly(meth)acrylate viscosity index improver comprising 10 to 90 mol % of the structural units represented by the following general formula (3) on the basis of the total monomer units in the polymer (hereinafter may be referred to as "viscosity index improver of the present embodiment"). In the present description, "(meth)acrylate" means "acrylate and/or methacrylate".

(3)

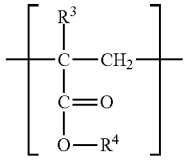

In the formula (3), $R^3$ is hydrogen or a methyl group, and $R^4$ is a linear or branched chain $C_{1-18}$ hydrocarbon group.

In one embodiment, $R^4$ is a $C_{1-5}$ hydrocarbon group or a $C_{6-18}$ hydrocarbon group, or any combination thereof.

The content of the (meth)acrylate structural units represented by the general formula (3) in the polymer in the viscosity index improver of the present embodiment is preferably 10 to 90 mol %, more preferably no more than 80 mol %, further preferably no more than 70 mol %, more preferably no less than 20 mol %, further preferably no less than 30 mol %, and especially preferably no less than 40 mol %. The content of the (meth)acrylate structural units represented by the general formula (3) on the basis of the total monomer units of the polymer of this upper limit or below makes it easy to improve solubility in the base oil and low-temperature viscosity characteristics, and to enhance improvement effect on viscosity-temperature characteristics. The content of this lower limit or over makes it easy to enhance improvement effect on viscosity-temperature characteristics.

The viscosity index improver of the present embodiment may be a copolymer comprising another (meth)acrylate structural unit in addition to the (meth)acrylate structural unit represented by the general formula (3). Such a copolymer can be obtained by copolymerizing one or more monomer(s) represented by the following general formula (4) (hereinafter referred to as "monomer (M-1)"), and a monomer other than the monomer (M-1):

(4)

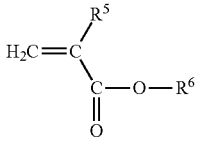

In the formula (4), $R^5$ represents a hydrogen atom or a methyl group, and $R^6$ represents a linear or branched chain $C_{1-18}$ hydrocarbon group.

In one embodiment, $R^6$ is a $C_{1-5}$ hydrocarbon group, or a $C_{6-18}$ hydrocarbon group, or any combination thereof.

Any monomer may be combined with the monomer (M-1). For example, a monomer represented by the following general formula (5) (hereinafter referred to as "monomer (M-2)") is preferable. A copolymer of the monomer (M-1)

and the monomer (M-2) is a so-called non-dispersant poly (meth)acrylate viscosity index improver.

(5)

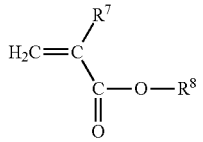

In the formula (5), $R^7$ represents a hydrogen atom or a methyl group, and $R^8$ represents a linear or branched chain hydrocarbon group having a carbon number of no less than 19.

$R^8$ in the monomer (M-2) represented by the formula (5) is a linear or branched chain hydrocarbon group having a carbon number of no less than 19 as described above, preferably a linear or branched chain hydrocarbon group having a carbon number of no less than 20, more preferably a linear or branched chain hydrocarbon group having a carbon number of no less than 22, and further preferably a branched chain hydrocarbon group having a carbon number of no less than 24. The upper limit of the carbon number of the hydrocarbon group represented by $R^8$ is not specifically restricted. $R^8$ is preferably a linear or branched chain hydrocarbon group having a carbon number of no more than 50,000, more preferably a linear or branched chain hydrocarbon group having a carbon number of no more than 500, further preferably a linear or branched chain hydrocarbon group having a carbon number of no more than 100, especially preferably a branched chain hydrocarbon group having a carbon number of no more than 50, and most preferably a branched chain hydrocarbon group having a carbon number of no more than 40.

In the viscosity index improver of the present embodiment, the polymer may comprise one kind of (meth)acrylate structural units corresponding to the monomer (M-2) alone, or may comprise two or more kinds thereof in combination. When the polymer comprises the structural units corresponding to the monomer (M-2), the content of the structural units corresponding to the monomer (M-2) on the basis of the total monomer units of the polymer is preferably 0.5 to 70 mol %, more preferably no more than 60 mol %, further preferably no more than 50 mol %, especially preferably no more than 40 mol %, most preferably no more than 30 mol %; preferably no less than 1 mol %, more preferably no less than 3 mol %, further preferably no less than 5 mol %, and especially preferably no less than 10 mol %. The content of the structural units corresponding to the monomer (M-2) on the basis of the total monomer units of the polymer of this upper limit or below makes it easy to enhance improvement effect on viscosity-temperature characteristics, and to improve low-temperature viscosity characteristics. The content thereof of this lower limit or over makes it easy to enhance improvement effect on viscosity-temperature characteristics.

One or more selected from a monomer represented by the following general formula (6) (hereinafter referred to as "monomer (M-3)"), and a monomer represented by the following general formula (7) (hereinafter referred to as "monomer (M-4)") is/are preferable as the other monomer to be combined with the monomer (M-1). A copolymer of the monomer (M-1) and the monomer(s) (M-3) and/or (M-4) is a so-called dispersant poly(meth)acrylate viscosity index improver. This dispersant poly(meth)acrylate viscosity index improver may further contain the monomer (M-2) as a constituting monomer.

(6)

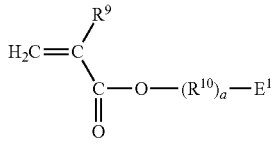

In the formula (6), $R^9$ represents a hydrogen atom or a methyl group, $R^{10}$ represents an alkylene group having a carbon number of 1 to 18, $E^1$ represents an amine residue or heterocyclic residue having 1 to 2 nitrogen atoms, and 0 to 2 oxygen atoms, and a represents 0 or 1.

Specific examples of an alkylene group having a carbon number of 1 to 18 represented by $R^{10}$ include ethylene group, propylene group, butylene group, pentylene group, hexylene group, heptylene group, octylene group, nonylene group, decylene group, undecylene group, dodecylene group, tridecylene group, tetradecylene group, pentadecylene group, hexadecylene group, heptadecylene group, and octadecylene group (each alkylene group may be either a linear or branched chain).

Specific examples of a residue represented by $E^1$ include dimethylamino group, diethylamino group, dipropylamino group, dibutylamino group, anilino group, toluidino group, xylidino group, acetylamino group, benzoylamino group, morpholino group, pyrrolyl group, pyrrolino group, pyridyl group, methylpyridyl group, pyrrolidinyl group, piperidinyl group, piperidino group, quinolyl group, pyrrolidonyl group, pyrrolidono group, imidazolino group, and pyrazinyl group.

(7)

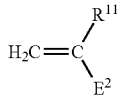

In the formula (7), $R^{11}$ represents a hydrogen atom or a methyl group, and $E^2$ represents an amine residue or heterocyclic residue having 1 to 2 nitrogen atoms, and 0 to 2 oxygen atoms.

Specific examples of a residue represented by $E^2$ include dimethylamino group, diethylamino group, dipropylamino group, dibutylamino group, anilino group, toluidino group, xylidino group, acetylamino group, benzoylamino group, morpholino group, pyrrolyl group, pyrrolino group, pyridyl group, methylpyridyl group, pyrrolidinyl group, piperidinyl group, piperidino group, quinolyl group, pyrrolidonyl group, pyrrolidono group, imidazolino group, and pyrazinyl group.

Preferred specific examples of the monomers (M-3) and (M-4) include dimethylaminomethyl methacrylate, diethylaminomethyl methacrylate, dimethylaminoethyl methacrylate, diethylaminoethyl methacrylate, 2-methyl-5-vinylpyridine, morpholinomethyl methacrylate, morpholinoethyl methacrylate, N-vinylpyrrolidone, and mixtures thereof.

Although the copolymerization molar ratio of the copolymer of the monomer (M-1) and the monomers (M-2) to (M-4) is not specifically restricted, monomer (M-1):monomers (M-2) to (M-4) is preferably approximately 20:80 to 90:10, more preferably 30:70 to 80:20, and further preferably 40:60 to 70:30.

The viscosity index improver of the present embodiment may be produced by any method. For example, a non-dispersant poly(meth)acrylate compound can be easily obtained by radical solution polymerization of the monomer (M-1) and the monomer (M-2) in the presence of a polymerization initiator (such as benzoyl peroxide). For another example, a dispersant poly(meth)acrylate compound can be easily obtained by polymerizing the monomer (M-1), at least one nitrogen-containing monomer selected from the monomers (M-3) and (M-4), and optionally the monomer (M-2) by radical solution polymerization in the presence of a polymerization initiator.

<(D) Molybdenum Friction Modifier>

The lubricating oil composition of the present invention preferably comprises (D) a molybdenum friction modifier (oil-soluble organic molybdenum compound; hereinafter may be referred to as "component (D)").

The content of the component (D) is preferably 100 to 2000 mass ppm in terms of molybdenum on the basis of the total mass of the composition. Preferred examples of the molybdenum friction modifier include molybdenum dithiocarbamate (sulfurized molybdenum dithiocarbamate or sulfurized oxymolybdenum dithiocarbamate. Hereinafter this may be referred to as "component (D1)").

For example, a compound represented by the following general formula (8) may be used as the component (D1):

(8)

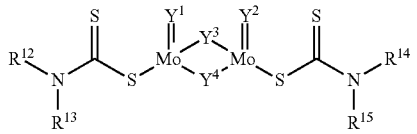

In the general formula (8), $R^{12}$ to $R^{18}$ may be either the same or different, and is a $C_{2-24}$ alkyl or $C_{6-24}$ (alkyl)aryl group, preferably a $C_{4-13}$ alkyl or $C_{10-15}$ (alkyl)aryl group. The alkyl group may be a primary, secondary, or tertiary alkyl group, and may be linear or branched. (Alkyl)aryl group means aryl or alkylaryl group. In the alkylaryl group, the alkyl substituent may be in any position of the aromatic ring. $Y^1$ to $Y^4$ are each independently a sulfur atom or oxygen atom. At least one of $Y^1$ to $Y^4$ is a sulfur atom.

Examples of the oil-soluble organic molybdenum compound other than the component (D1) include molybdenum dithiophosphate; complexes or the like of a molybdenum compound (e.g. molybdenum oxides such as molybdenum dioxide and molybdenum trioxide; molybdic acids such as orthomolybdic acid, paramolybdic acid, and sulfurized (poly)molybdic acid; molybdate salts such as metal salts and ammonium salts of these molybdic acids; molybdenum sulfides such as molybdenum disulfide, molybdenum trisulfide, molybdenum pentasulfide, and molybdenum polysulfide; sulfurized molybdic acid, and metal salts or amine salts of thereof; and molybdenum halides such as molybdenum chloride) and a sulfur-containing organic compound (such as alkyl (thio)xanthate, thiadiazole, mercaptothiadiazole, thiocarbonate, tetrahydrocarbyl thiuram disulfide, bis(di(thio) hydrocarbyl dithiophosphonate) disulfide, organic (poly) sulfide and sulfurized ester) or other organic compound; and sulfur-containing organic molybdenum compounds such as complexes of a sulfur-containing molybdenum compound (such as the above described molybdenum sulfides, and sulfurized molybdic acid), and an alkenylsuccinimide. These organic molybdenum compounds may be either mononuclear molybdenum compounds, or polynuclear molybdenum compounds such as binuclear or trinuclear molybdenum compounds.

As the oil-soluble organic molybdenum compound other than the component (D1), an organic molybdenum compound that does not contain sulfur as a constituent element may be used. Specific examples of the organic molybdenum compound that does not contain sulfur as a constituent element include: molybdenum-amine complexes, molybdenum-succinimide complexes, molybdenum salts of organic acids, molybdenum salts of alcohols, or the like. Among them, molybdenum-amine complexes, molybdenum salts of organic acids, or molybdenum salts of alcohols are preferable.

When the lubricating oil composition comprises the component (D), the content thereof is, in terms of molybdenum on the basis of the total mass of the composition, normally 100 to 2000 mass ppm, preferably no less than 300 mass ppm, more preferably no less than 500 mass ppm, further preferably no less than 700 mass ppm, preferably no more than 1500 mass ppm, more preferably no more than 1200 mass ppm, and further preferably no more than 1000 mass ppm. The molybdenum content of this lower limit or over makes it possible to improve fuel efficiency and LSPI suppression. The molybdenum content of this upper limit or below makes it possible to improve the storage stability of the lubricating oil composition.

<(E) Nitrogen-Containing Ashless Dispersant>

The lubricating oil composition of the present invention may comprise (E) a nitrogen-containing ashless dispersant (hereinafter may be referred to as "component (E)").

Examples of the component (E) include at least one compound selected from the following (E-1) to (E-3):

(E-1) succinimide having at least one alkyl or alkenyl group in its molecule, or derivatives thereof (hereinafter may be referred to as "component (E-1)");

(E-2) benzylamine having at least one alkyl or alkenyl group in its molecule, or derivatives thereof (hereinafter may be referred to as "component (E-2)"); and (E-3) polyamine having at least one alkyl or alkenyl group in its molecule, or derivatives thereof (hereinafter may be referred to as "component (E-3)").

The component (E-1) may be especially preferably used as the component (E).

In the component (E-1), examples of succinimide having at least one alkyl or alkenyl group in its molecule include compounds represented by the following formula (9) or (10):

(9)

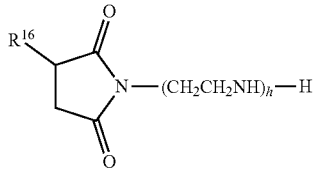

(10)

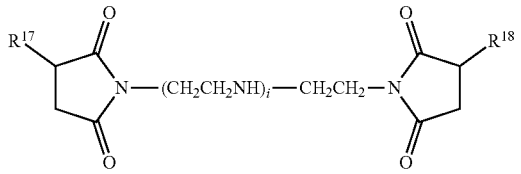

In the formula (9), $R^{16}$ is a $C_{40-400}$ alkyl or alkenyl group; h represents an integer of 1 to 5, preferably 2 to 4. The carbon number of $R^{16}$ is preferably no less than 60, and preferably no more than 350.

In the formula (10), $R^{17}$ and $R^{18}$ are each independently $C_{40-400}$ alkyl or alkenyl group, and may be combination of different groups. $R^{17}$ and $R^{18}$ are especially preferably polybutenyl groups. i represents an integer of 0 to 4, preferably 1 to 4, and more preferably 1 to 3. The carbon numbers of $R^{17}$ and $R^{18}$ are each preferably no less than 60, and preferably no more than 350.

The carbon numbers of $R^{16}$ to $R^{18}$ in the formulae (9) and (10) of these lower limits or over make it possible to obtain good solubility in the lubricating base oil. The carbon numbers of $R^{16}$ to $R^{18}$ of these upper limits or below can improve the low-temperature fluidity of the lubricating oil composition.

The alkyl or alkenyl groups ($R^{16}$ to $R^{18}$) in the formulae (9) and (10) may be linear or branched. Preferred examples thereof include branched alkyl groups and branched alkenyl groups derived from oligomers of olefins such as propene, 1-butene, and isobutene, or from co-oligomers of ethylene and propylene. Among them, a branched alkyl or alkenyl group derived from oligomers of isobutene that are conventionally referred to as polyisobutylene, or a polybutenyl group is most preferable.

Preferred number average molecular weights of the alkyl or alkenyl groups ($R^{16}$ to $R^{18}$) in the formulae (9) and (10) are each 800 to 3500.

Succinimide having at least one alkyl or alkenyl group in its molecule includes so-called monotype succinimide represented by the formula (9) wherein addition of succinic anhydride has occurred at only one end of a polyamine chain, and so-called bistype succinimide represented by the formula (10) wherein addition of succinic anhydrides has occurred at both ends of a polyamine chain. The lubricating oil composition of the present invention may include either monotype or bistype succinimide, and may include both of them as a mixture.

A method for producing the succinimide having at least one alkyl or alkenyl group in its molecule is not specifically limited. For example, such succinimide can be obtained by: reacting an alkyl succinic acid or an alkenyl succinic acid obtained by reacting a compound having a $C_{40-400}$ alkyl or alkenyl group with maleic anhydride at 100 to 200° C., with a polyamine. Here, examples of the polyamine include diethylenetriamine, triethylenetetramine, tetraethylenepentamine, and pentaethylenehexamine.

In the component (E-2), examples of benzylamine having at least one alkyl or alkenyl group in its molecule include compounds represented by the following formula (11):

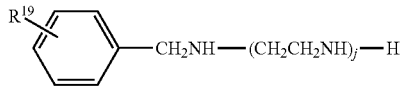

(11)

In the formula (11), $R^{19}$ is a $C_{40-400}$ alkyl or alkenyl group; and j represents an integer of 1 to 5, preferably 2 to 4. The carbon number of $R^{19}$ is preferably no less than 60, and preferably no more than 350.

A method for producing the component (E-2) is not specifically limited. An example of such a method is: reacting a polyolefin such as propylene oligomer, polybutene, and ethylene-α-olefin copolymer, with phenol, to give an alkylphenol; and then reacting the alkylphenol with formaldehyde, and a polyamine such as diethylenetriamine, triethylenetetramine, tetraethylenepentamine, and pentaethylenehexamine, by Mannich reaction.

In the component (E-3), examples of a polyamine having at least one alkyl or alkenyl group in its molecule include compounds represented by the following formula (12):

$$R^{20}—NH—(CH_2CH_2NH)_k—H \quad (12)$$

In the formula (12), $R^{20}$ is a $C_{40-400}$ alkyl or alkenyl group, and k represents an integer of 1 to 5, preferably 2 to 4. The carbon number of $R^{20}$ is preferably no less than 60, and preferably no more than 350.

A method for producing the component (E-3) is not specifically limited. An example of such a method is: chlorinating a polyolefin such as propylene oligomer, polybutene, and ethylene-α-olefin copolymer; and then reacting the chlorinated polyolefin with ammonia, or a polyamine such as ethylenediamine, diethylenetriamine, triethylenetetramine, tetraethylenepentamine, and pentaethylenehexamine.

Examples of derivatives in the components (E-1) to (E-3) include:

(i) an oxygen-containing organic compound-modified compound where a part or all of the residual amino and/or imino groups is/are neutralized or amidated by reacting the succinimide, benzylamine, or polyamine having at least one alkyl or alkenyl group in its molecule (hereinafter referred to as "the above described nitrogen-containing compound") with a $C_{1-30}$ monocarboxylic acid such as fatty acids, a $C_{2-30}$ polycarboxylic acid (such as ethanedioic acid, phthalic acid, trimellitic acid, and pyromellitic acid), an anhydride or ester thereof, a $C_{2-6}$ alkylene oxide, or a hydroxy(poly)oxyalkylene carbonate;

(ii) a boron-modified compound where a part or all of the residual amino and/or imino groups is/are neutralized or amidated by reacting the above described nitrogen-containing compound with boric acid;

(iii) a phosphoric acid-modified compound where a part or all of the residual amino and/or imino groups is/are neutralized or amidated by reacting the above described nitrogen-containing compound with phosphoric acid;

(iv) a sulfur-modified compound obtained by reacting the above described nitrogen-containing compound with a sulfur compound; and (v) a modified compound obtained by two or more modifications selected from oxygen-containing organic compound-modification, boron-modification, phosphoric acid-modification, and sulfur-modification, on the above described nitrogen-containing compound. Among the derivatives (i) to (v), using a boron-modified compound of alkenylsuccinimide, especially a boron-modified compound of bistype alkenylsuccinimide can further improve the thermal stability of the lubricating oil composition.

The molecular weight of the component (E) is not specifically limited, and preferred weight average molecular weight thereof is 1000 to 20000.

When the lubricating oil composition comprises the component (E), the content thereof is, in terms of nitrogen on the basis of the total mass of the composition, preferably no less than 100 mass ppm, more preferably no less than 300 mass ppm, preferably no more than 1500 mass ppm, and more preferably no more than 1000 mass ppm. The content of the component (E) of this lower limit or over can sufficiently improve anti-coking performance (thermal durability) of the lubricating oil composition. The content thereof of this upper limit or below makes it possible to maintain high fuel efficiency.

When the component (E) comprises boron, the boron content in the lubricating oil composition derived from the component (E) is, on the basis of the total mass of the composition, preferably no more than 400 mass ppm, more preferably no more than 350 mass ppm, and especially preferably no more than 300 mass ppm. The boron content derived from the component (E) of this upper limit or below makes it possible to maintain high fuel efficiency while keeping the ash content of the composition low.

<Other Additives>

Other additives that are commonly used in lubricating oil may be incorporated in the lubricating oil composition of the present invention according to its purpose in order to further improve its performance. Examples of such additives include additives such as zinc dialkyldithiophosphate, an antioxidant, an anti-wear agent or extreme-pressure agent, an ashless friction modifier, a corrosion inhibitor, an anti-rust agent, a metal deactivator, a demulsifier, and a defoaming agent.

For example, a compound represented by the following general formula (13) may be used as zinc dialkyldithiophosphate (ZnDTP):

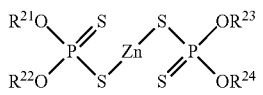

(13)

In the formula (13), $R^{2'}$ to $R^{24}$ each independently represent a $C_{1-24}$ linear or branched alkyl group, and may be combination of different groups. The carbon numbers of $R^{21}$ to $R^{24}$ are each preferably no less than 3, preferably no more than 12, and more preferably no more than 8. $R^{21}$ to $R^{24}$ may be primary, secondary, or tertiary alkyl groups, and preferably primary or secondary alkyl groups or combination thereof. Further, the molar ratio of the primary alkyl group and the secondary alkyl group (primary alkyl group:secondary alkyl group) is preferably 0:100 to 30:70. This ratio may be the intramolecular combination ratio of alkyl chains, or may be the mixing ratio of ZnDTP having only the primary alkyl group and ZnDTP having only the secondary alkyl group. When the secondary alkyl group is major, fuel efficiency can be further improved.

A method for producing the zinc dialkyldithiophosphate is not specifically restricted. For example, the zinc dialkyldithiophosphate may be synthesized by: reacting alcohol(s) having an alkyl group corresponding to $R^{21}$ to $R^{24}$ with phosphorus pentasulfide, to synthesize dithiophosphoric acid; and neutralizing the dithiophosphoric acid with zinc oxide.

When the lubricating oil composition comprises ZnDTP, the content thereof is preferably no less than 600 mass ppm, and preferably no more than 800 mass ppm, in terms of phosphorous on the basis of the total mass of the composition. The content of ZnDTP of this lower limit or over makes it possible to improve not only oxidation stability but also LSPI suppression. The content of ZnDTP of this upper limit or below makes it easy to reduce catalyst poisoning by an exhaust gas purifying catalyst.

Any known antioxidant such as a phenolic antioxidant and an amine antioxidant may be used as the antioxidant. Examples thereof include: amine antioxidants such as alkylated diphenylamine, phenyl-α-naphthylamine, and alkylated a-naphthylamine; and phenolic antioxidants such as 2,6-di-t-butyl-4-methylphenol, and 4,4'-methylenebis(2,6-di-t-butylphenol).

When the lubricating oil composition comprises the antioxidant, the content thereof is usually no more than 5.0 mass %, preferably no more than 3.0 mass %, preferably no less than 0.1 mass %, and more preferably no less than 0.5 mass %, on the basis of the total mass of the composition.

Any anti-wear agent or extreme pressure agent used for lubricating oil may be used as the anti-wear agent or extreme pressure agent without particular limitation. Examples thereof include sulfur, phosphorous, and sulfur-phosphorous extreme pressure agents. Specific examples include phosphite esters, thiophosphite esters, dithiophosphite esters, trithiophosphite esters, phosphate esters, thiophosphate esters, dithiophosphate esters, trithiophosphate esters, amine salts thereof, metal salts thereof, derivatives thereof, dithiocarbamates, zinc dithiocarbamate, disulfides, polysulfides, sulfurized olefins, and sulfurized oils. Among them, addition of a sulfur extreme pressure agent, especially a sulfurized oil is preferable.

When the lubricating oil composition comprises the anti-wear agent or extreme pressure agent, the content thereof is preferably 0.01 to 10 mass % on the basis of the total mass of the composition.

Any compound usually used as an ashless friction modifier for lubricating oil may be used as the ashless friction modifier without particular limitation. Examples of the ashless friction modifier include compounds each having one or more heteroatoms selected from oxygen, nitrogen, and sulfur in the molecule, and each having a carbon number of 6 to 50. More specific examples thereof include ashless friction modifiers such as amine compounds, fatty acid esters, fatty acid amides, fatty acids, aliphatic alcohols, aliphatic ethers, urea compounds, and hydrazide compounds, each having at least one alkyl or alkenyl group having a carbon number of 6-30, preferably a linear alkyl group, a linear alkenyl group, a branched alkyl group, or a branched alkenyl group having a carbon number of 6-30, in the molecule.

When the lubricating oil composition comprises the ashless friction modifier, the content thereof is usually 1000 to 10000 mass ppm, preferably no less than 3000 mass ppm, and preferably no more than 8000 mass ppm, on the basis of the total mass of the composition. The content of the ashless friction modifier of this lower limit or over makes it possible to obtain sufficient friction reducing effect by the addition of the friction modifier. The content thereof of this upper limit or below makes it easy to prevent effect of an anti-wear additive etc. from being blocked, and makes it easy to improve solubility of an additive.

Any known corrosion inhibitor may be used as the corrosion inhibitor. Examples thereof include benzotriazole compounds, tolyltriazole compounds, thiadiazole compounds, and imidazole compounds. When the lubricating oil composition comprises the corrosion inhibitor, the content thereof is usually 0.005 to 5 mass % on the basis of the total mass of the composition.

Any known anti-rust agent may be used as the anti-rust agent. Examples thereof include petroleum sulfonates, alkylbenzenesulfonates, dinonylnaphthalenesulfonates, alkylsulfonate salts, fatty acids, alkenylsuccinimide half esters, fatty acid soaps, fatty acid polyol esters, fatty acid amine salts, oxidized paraffins, and alkyl polyoxyethylene ethers. When the lubricating oil composition comprises the anti-rust agent, the content thereof is usually 0.005 to 5 mass % on the basis of the total mass of the composition.

Any known metal deactivator may be used as the metal deactivator. Examples thereof include imidazolines, pyrimidine derivatives, alkylthiadiazoles, mercaptobenzothiazoles, benzotriazoles and derivatives thereof, 1,3,4-thiadiazole polysulfide, 1,3,4-thiadiazolyl-2,5-bis(dialkyl dithiocarbamate), 2-(alkyldithio)benzimidazole, and β-(o-carboxybenzylthio)propionitrile. When the lubricating oil composition comprises the metal deactivator, the content thereof is usually 0.005 to 1 mass % on the basis of the total mass of the composition.

Any known demulsifier may be used as the demulsifier. Examples thereof include polyalkylene glycol nonionic surfactants. When the lubricating oil composition comprises the demulsifier, the content thereof is usually 0.005 to 5 mass % on the basis of the total mass of the composition.

Any known defoaming agent may be used as the defoaming agent. Examples thereof include silicones, fluorosilicones, and fluoroalkyl ethers. When the lubricating oil composition comprises the defoaming agent, the content thereof is usually 0.0001 to 0.1 mass % on the basis of the total mass of the composition.

For example, a known coloring agent such as azo compounds may be used as the coloring agent.

<Lubricating Oil Composition>

The kinematic viscosity of the lubricating oil composition at 100° C. is preferably 4.0 to 6.1 $mm^2/s$, more preferably no more than 5.5 $mm^2/s$, and more preferably no less than 4.5 $mm^2/s$. The kinematic viscosity of the lubricating oil composition at 100° C. of this upper limit or below makes it possible to further improve fuel efficiency. The kinematic viscosity thereof of this lower limit or over makes it easy to improve lubricity.

The kinematic viscosity of the lubricating oil composition at 40° C. is preferably 4.0 to 50 $mm^2/s$, more preferably no more than 40 $mm^2/s$, especially preferably no more than 35 $mm^2/s$, more preferably no less than 15 $mm^2/s$, further preferably no less than 18 $mm^2/s$, and especially preferably no less than 20 $mm^2/s$. The kinematic viscosity of the lubricating oil composition at 40° C. of this lower limit or over makes it easy to improve lubricity. The kinematic viscosity thereof of this upper limit or below makes it easy to obtain necessary low-temperature viscosity, and makes it possible to further improve fuel efficiency.

The viscosity index of the lubricating oil composition is preferably no less than 100, more preferably no less than 120, and especially preferably no less than 130. The viscosity index of the lubricating oil composition of this lower limit or over makes it easy to improve the fuel efficiency while keeping the HTHS viscosity at 150° C., and makes it easy to reduce the low-temperature viscosity (for example, at −35° C. that is measurement temperature of the CCS viscosity specified in the SAE viscosity grade 0W-X, known as viscosity grades of fuel-economy oil).

The HTHS viscosity of the lubricating oil composition at 150° C. is preferably 1.7 to 2.0 mPa·s, and more preferably no more than 1.9 mPa·s. In the present description, the HTHS viscosity at 150° C. is high temperature high shear viscosity at 150° C., specified in ASTM D4683. The HTHS viscosity at 150° C. of this lower limit or over makes it easy to improve lubricity. The HTHS viscosity at 150° C. of this upper limit or below makes it possible to further improve fuel efficiency.

The HTHS viscosity of the lubricating oil composition at 100° C. is preferably 3.5 to 4.4 mPa·s, more preferably no more than 4.2 mPa·s, more preferably no less than 3.7 mPa·s, and especially preferably no less than 3.8 mPa·s. In the present description, the HTHS viscosity at 100° C. is high temperature high shear viscosity at 100° C., specified in ASTM D4683. The HTHS viscosity at 100° C. of this lower limit or over makes it easy to improve lubricity. The HTHS viscosity at 100° C. of this upper limit or below makes it easy to obtain necessary low-temperature viscosity, and makes it possible to further improve fuel efficiency.

The evaporation loss of the lubricating oil composition is, as NOACK evaporation loss at 250° C., preferably no more than 15 mass %, and more preferably no more than 14.5 mass %. The NOACK evaporation loss of the lubricating oil composition of this upper limit or below makes it possible to further reduce the evaporation loss of the lubricating oil, which makes it possible to further suppress the increase of the viscosity. The NOACK evaporation loss in the present description is the evaporation loss of the lubricating oil measured conforming to ASTM D 5800. The lower limit of the NOACK evaporation loss of the lubricating oil composition at 250° C. is not specifically restricted, and normally no less than 5 mass %.

EXAMPLES

Hereinafter the present invention will be more specifically described based on Examples and Comparative examples. The present invention is not limited to these examples.

Examples 1 to 6 and Comparative Examples 1 to 4

The lubricating oil compositions of the present invention (Examples 1 to 6) and lubricating oil compositions for comparison (Comparative examples 1 to 4) were prepared using the following base oils and additives. The formation of each composition is shown in Tables 1 and 2. In Tables 1 and 2, "mass %" for the base oil represents mass % on the basis of the total mass of the base oils, "mass %" for components other than the base oil represents mass % on the basis of the total mass of the composition, and "mass ppm" represents mass ppm on the basis of the total mass of the composition.

(Base Oil)

O-1: Group II base oil of API base stock categories (hydrocracked mineral base oil, Yubase™ 3 from SK Lubricants Co., Ltd.), kinematic viscosity (100° C.): 3.05 $mm^2/s$, kinematic viscosity (40° C.): 12.3 $mm^2/s$, viscosity index: 105, NOACK evaporation loss (250° C., 1 h): 40 mass %, % $C_P$: 72.6%, % $C_N$: 27.4%, % $C_A$: 0%, saturated content: 99.6 mass %, aromatic content: 0.3 mass %, resin content: 0.1 mass %

O-2: Group III base oil of API base stock categories (hydrocracked mineral base oil, Yubase™ 4 from SK Lubricants Co., Ltd.), kinematic viscosity (100° C.): 4.24 $mm^2/s$, kinematic viscosity (40° C.): 19.3 $mm^2/s$, viscosity index: 127, NOACK evaporation loss (250° C., 1 h): 14.7 mass %, % $C_P$: 80.7%, % $C_N$: 19.3%, % $C_A$: 0%, saturated content: 99.7 mass %, aromatic content: 0.2 mass %, resin content: 0.1 mass %

O-3: Group III base oil of API base stock categories (hydrocracked mineral base oil, Yubase™ 4 PLUS from SK Lubricants Co., Ltd.), kinematic viscosity (100° C.): 4.15 $mm^2/s$, kinematic viscosity (40° C.): 18.7 $mm^2/s$, viscosity index: 135, NOACK evaporation loss (250° C., 1 h): 13.5 mass %, % $C_P$: 87.3%, % $C_N$: 12.7%, % $C_A$: 0%, saturated content: 99.6 mass %, aromatic content: 0.2 mass %, resin content: 0.2 mass %

O-4: Group IV base oil of API base stock categories (poly α-olefin, SpectraSyn™ 2 from ExxonMobil Chemical Company), kinematic viscosity (100° C.): 1.69 $mm^2/s$, kinematic viscosity (40° C.): 5.06 $mm^2/s$, NOACK evaporation loss (250° C., 1 h): 100 mass %

O-5: Group IV base oil of API base stock categories (poly α-olefin, SpectraSyn™ 4 from ExxonMobil Chemical Company), kinematic viscosity (100° C.): 4.07 $mm^2/s$, kinematic viscosity (40° C.): 18.2 $mm^2/s$, viscosity index: 125, NOACK evaporation loss (250° C., 1 h): 12.7 mass %

(Metallic Detergent)

A-1: calcium borate-overbased calcium salicylate, Ca content: 6.8 mass %, B content: 2.7 mass %, base number (perchloric acid method): 190 mgKOH/g B-1: magnesium carbonate-overbased magnesium sulfonate, Mg content: 9.1 mass %, base number (perchloric acid method): 405 mgKOH/g A*-2: calcium carbonate-overbased calcium salicylate, Ca content: 8.0 mass %, base number (perchloric acid method): 225 mgKOH/g (calcium detergent not falling under the component (A))

(Viscosity Index Improver)

C-1: non-dispersant polymethacrylate viscosity index improver, weight average molecular weight: 400,000

(Friction Modifier)

D-1: sulfurized (oxy)molybdenum dithiocarbamate (molybdenum friction modifier), Mo content: 10 mass %

(Ashless Dispersant)

E-1: polybutenyl succinimide, nitrogen content: 1.6 mass %, boron content: 0 mass %

(Other Additives)

Antioxidant F-1: amine antioxidant (diphenylamine)

Antioxidant F-2: hindered phenol antioxidant

ZnDTP: zinc dialkyldithiophosphate, P content: 7.2 mass %, S content: 14.1 mass %, Zn content: 7.85 mass %

TABLE 1

| | | Examples | | | | | |
|---|---|---|---|---|---|---|---|
| | | 1 | 2 | 3 | 4 | 5 | 6 |
| Base oil | | | | | | | |
| O-1 | mass % | 1 | 5 | 5 | | 5 | 5 |
| O-2 | mass % | 99 | | | | | |
| O-3 | mass % | | 95 | 95 | | 95 | 95 |
| O-4 | mass % | | | | 1.5 | | |
| O-5 | mass % | | | | 98.5 | | |
| Base oil properties | | | | | | | |
| Kinematic viscosity (40° C.) | $mm^2/s$ | 19.2 | 18.3 | 18.3 | 17.7 | 18.3 | 18.3 |
| Kinematic viscosity (100° C.) | $mm^2/s$ | 4.23 | 4.08 | 4.08 | 4.00 | 4.08 | 4.08 |
| NOACK evaporation loss (250° C., 1 hr) | mass % | 15.0 | 14.8 | 14.8 | 14.0 | 14.8 | 14.8 |
| Metallic detergent | | | | | | | |
| A-1 | mass % | 2.06 | 2.06 | 2.06 | 2.06 | 1.76 | 2.50 |
| B-1 | mass % | 0.45 | 0.45 | 0.45 | 0.45 | 0.45 | 0.45 |
| A*-2 | mass % | | | | | | |
| Viscosity index improver | | | | | | | |
| C-1 | mass % | 0.00 | 0.00 | 0.80 | 0.00 | 0.00 | 0.00 |
| Friction modifier | | | | | | | |
| D-1 | mass % | 0.80 | 0.80 | 0.80 | 0.80 | 0.80 | 0.80 |
| Ashless dispersant | | | | | | | |
| E-1 | mass % | 4.00 | 4.00 | 4.00 | 4.00 | 4.00 | 4.00 |
| Antioxidant | | | | | | | |
| F-1 | mass % | 0.40 | 0.40 | 0.40 | 0.40 | 0.40 | 0.40 |
| F-2 | mass % | 0.40 | 0.40 | 0.40 | 0.40 | 0.40 | 0.40 |
| ZnDTP | mass % | 1.00 | 1.00 | 1.00 | 1.00 | 1.00 | 1.00 |
| Properties of composition | | | | | | | |
| Kinematic viscosity (40° C.) | $mm^2/s$ | 26.14 | 24.09 | 24.55 | 24.05 | 23.66 | 24.09 |
| Kinematic viscosity (100° C.) | $mm^2/s$ | 5.30 | 5.10 | 5.24 | 5.02 | 5.05 | 5.12 |
| Viscosity index | | 140 | 146 | 152 | 140 | 147 | 148 |
| HTHS viscosity (100° C.) | mPa · s | 4.18 | 3.99 | 4.06 | 3.91 | 4.04 | 4.11 |
| HTHS viscosity (150° C.) | mPa · s | 1.87 | 1.85 | 1.86 | 1.76 | 1.81 | 1.83 |
| NOACK evaporation loss (250° C., 1 hr) | mass % | 14.4 | 14.2 | 13.4 | 11.7 | 14.6 | 14 |
| Elemental analysis | | | | | | | |
| B | mass ppm | 550 | 550 | 550 | 550 | 450 | 640 |
| Ca | mass ppm | 1400 | 1400 | 1400 | 1400 | 1200 | 1700 |
| Mg | mass ppm | 420 | 420 | 420 | 420 | 420 | 420 |
| Mo | mass ppm | 800 | 800 | 800 | 800 | 800 | 800 |
| P | mass ppm | 720 | 720 | 720 | 720 | 720 | 720 |
| S | mass % | 0.24 | 0.24 | 0.24 | 0.24 | 0.24 | 0.24 |
| Zn | mass ppm | 790 | 790 | 790 | 790 | 790 | 790 |
| N | mass ppm | 900 | 900 | 900 | 900 | 900 | 900 |
| Panel coking test | | | | | | | |
| Coke deposited on the panel | mg | 8.6 | 6.8 | 52.3 | 2.4 | 14.7 | 13.2 |
| LSPI frequency index | | 0.29 | 0.29 | 0.29 | 0.29 | 0.16 | 0.49 |

TABLE 2

| | | Comparative examples | | | |
|---|---|---|---|---|---|
| | | 1 | 2 | 3 | 4 |
| Base oil | | | | | |
| O-1 | mass % | 5 | 12 | 5 | 5 |
| O-2 | mass % | | | | |
| O-3 | mass % | 95 | 88 | 95 | 95 |
| O-4 | mass % | | | | |
| O-5 | mass % | | | | |
| Base oil properties | | | | | |
| Kinematic viscosity (40° C.) | $mm^2/s$ | 18.3 | 17.7 | 18.3 | 18.3 |
| Kinematic viscosity (100° C.) | $mm^2/s$ | 4.08 | 4.00 | 4.08 | 4.08 |
| NOACK evaporation loss (250° C., 1 hr) | mass % | 14.8 | 16.7 | 14.8 | 14.8 |
| Metallic detergent | | | | | |
| A-1 | mass % | 2.06 | 2.06 | | |
| B-1 | mass % | 0.45 | 0.45 | | 0.45 |
| A*-2 | mass % | | | 2.50 | 1.75 |
| Viscosity index improver | | | | | |
| C-1 | mass % | 1.00 | 0.00 | 0.00 | 0.00 |
| Friction modifier | | | | | |
| D-1 | mass % | 0.80 | 0.80 | 0.80 | 0.80 |
| Ashless dispersant | | | | | |
| E-1 | mass % | 4.00 | 4.00 | 4.00 | 4.00 |
| Antioxidant | | | | | |
| F-1 | mass % | 0.40 | 0.40 | 0.40 | 0.40 |
| F-2 | mass % | 0.40 | 0.40 | 0.40 | 0.40 |
| ZnDTP | mass % | 1.00 | 1.00 | 1.00 | 1.00 |
| Properties of composition | | | | | |
| Kinematic viscosity (40° C.) | $mm^2/s$ | 24.67 | 23.53 | 24.11 | 23.64 |
| Kinematic viscosity (100° C.) | $mm^2/s$ | 5.27 | 5.00 | 5.09 | 5.01 |
| Viscosity index | | 153 | 144 | 145 | 143 |
| HTHS viscosity (100° C.) | mPa · s | 4.08 | 3.95 | 4.03 | 3.93 |
| HTHS viscosity (150° C.) | mPa · s | 1.87 | 1.80 | 1.86 | 1.81 |
| NOACK evaporation loss (250° C., 1 hr) | mass % | 14.0 | 16.2 | 13.6 | 14.0 |
| Elemental analysis | | | | | |
| B | mass ppm | 550 | 550 | <1 | <1 |
| Ca | mass ppm | 1400 | 1400 | 2000 | 1400 |
| Mg | mass ppm | 420 | 420 | <10 | 420 |
| Mo | mass ppm | 800 | 800 | 800 | 800 |
| P | mass ppm | 720 | 720 | 720 | 720 |
| S | mass % | 0.24 | 0.24 | 0.23 | 0.23 |
| Zn | mass ppm | 790 | 790 | 790 | 790 |
| N | mass ppm | 900 | 900 | 900 | 900 |
| Panel coking test | | | | | |
| Coke deposited on the panel | mg | 111.0 | 36.1 | 20.6 | 90.2 |
| LSPI frequency index | | 0.29 | 0.29 | 0.68 | 0.29 |

(Panel Coking Test)

Detergency of each of the lubricating oil compositions was evaluated using a panel coking test. Conforming to Tentative Standard Method 3462-T of Federal 791 Test Method, the sequence of 15 seconds of mechanically splashing a sample oil (oil temperature: 100° C.) against a panel (panel temperature: 300° C.) by means of a bar followed by 45 seconds of an interval was repeated for 3 hours, and thereafter the amount of coke deposited on the panel after the test was measured. The results are shown in Tables 1 and 2. In this test, the amount of coke deposited on the panel being no more than 80 mg means good detergency.

(LSPI Frequency)

Non Patent Literature 1 reports that LSPI occurrence frequency when a lubricating oil composition is used for lubrication of an internal combustion engine shows a positive correlation with Ca content in the lubricating oil composition, and shows negative correlations with P content and Mo content in the lubricating oil composition. More specifically, Non Patent Literature 1 reports that LSPI occurrence frequency can be estimated by the following regression formula, based on contents of respective elements in the lubricating oil composition:

$$\text{LSPI frequency index} = 6.59 \times Ca - 26.6 \times P - 5.12 \times Mo + 1.69 \quad (14)$$

In the formula (14), Ca represents calcium content in the composition (mass %), P represents phosphorous content in the composition (mass %), and Mo represents molybdenum content in the composition (mass %).

The LSPI frequency index of each of the compositions of Examples and Comparative Examples according to the formula (14) is shown in Table 1. A LSPI frequency index calculated by the formula (14) is a relative value based on the LSPI frequency when a conventionally known engine oil (API SM 0W-20) is used. That is, a LSPI frequency index by the formula (14) is normalized so that the value calculated from the formulation of the engine oil API SM 0W-20 is 1. For example, when a LSPI frequency index calculated from the formulation of some lubricating oil composition according to the formula (14) is 0.5, the LSPI frequency when the lubricating oil composition is used for lubrication of an internal combustion engine is estimated to be 50% of the LSPI frequency when the conventionally known engine oil API SM 0W-20 is used. While the formula (14) is a regression formula solely based on measurement results of compositions containing a calcium carbonate-overbased calcium detergent, the compositions of Examples contained a calcium borate-overbased calcium detergent (component A-1). As described above, the lubricating oil composition containing a calcium borate-overbased calcium detergent offers suppression of LSPI owing to a process in which calcium borate captures and absorbs CaO formed in a cylinder. Thus, the compositions of Examples offers further suppression of LSPI occurrence frequency than that estimated by the LSPI frequency index calculated from the formula (14).

All the compositions of Examples 1 to 6 had low viscosities, and had detergency superior to that of Comparative example 1 which contained the viscosity index improvers of more than a specified amount, lower evaporation losses than that of Comparative example 2 which had a NOACK evaporation loss of the base oil of more than a specified value, LSPI suppression superior to that of Comparative example 3 which contained calcium derived from the metallic detergents of more than a specified amount, and detergency superior to that of Comparative example 4 which contained metallic detergents but did not contain any calcium borate-containing metallic detergent.

It is understood from these results that the lubricating oil composition for an internal combustion engine of the present invention can improve fuel efficiency, LSPI suppression, oil consumption suppression, and detergency in a well-balanced manner.

INDUSTRIAL APPLICABILITY

The lubricating oil composition for an internal combustion engine of the present invention can improve fuel efficiency, LSPI suppression, oil consumption suppression, and detergency in a well-balanced manner. Thus, the lubricating oil composition of the present invention may be preferably used for lubrication of a turbocharged gasoline engine that easily has the problem of LSPI, especially a turbocharged direct injection engine.

We claim:

1. A lubricating oil composition for an internal combustion engine, the composition consisting of:

a lubricating base oil consisting of at least one mineral base oil or at least one synthetic base oil or any combination thereof, the lubricating base oil having a kinematic viscosity at 100° C. of 4.0 to 4.5 $mm^2/s$ and a NOACK evaporation loss at 250° C. of no more than 15 mass %, and at least one additive other than any base oil component, the at least one additive comprising:

(A) a calcium borate-containing metallic detergent in an amount of no less than 1000 mass ppm and less than 2000 mass ppm in terms of calcium on the basis of the total mass of the composition;

optionally (B) a magnesium-containing metallic detergent; and optionally (C) a viscosity index improver in an amount of less than 1.0 mass % on the basis of the total mass of the composition;

wherein the composition has a HTHS viscosity at 150° C. of 1.7 to 2.0 mPa·s;

each of the at least one mineral base oil is a Group II or III base oil of API base stock categories obtained by a process comprising:

(i) refining at least one raw material oil selected from the following (1) to (8) or at least one lubricating oil fraction recovered therefrom or any combination thereof, and (ii) recovering a lubricating oil fraction from a product of the (i), wherein the refining in the (i) comprises solvent deasphalting, solvent refining, hydrocracking, hydroisomerizing, hydrorefining, hydrofinishing, dewaxing, white clay treatment, or chemical washing, or any combination thereof:

(1) a distillate obtained by atmospheric distillation of a paraffin base crude oil and/or a mixed base crude oil;

(2) a distillate obtained by vacuum distillation of residue of atmospheric distillation of a paraffin base crude oil and/or a mixed base crude oil;

(3) a wax obtained through a lubricating oil dewaxing process;

(4) a mixed oil of at least one selected from the (1) to (3), and/or a mild hydrocracked oil of the mixed oil;

(5) a mixed oil of at least two selected from the (1) to (4);

(6) a deasphalted oil of the (1), (2), (3), (4), or (5);

(7) a mild hydrocracked oil of the (6); and (8) a mixed oil of at least two selected from the (1) to (7); and each of the at least one synthetic base oil is a poly α-olefin or a hydrogenated product thereof, an isobutene oligomer or a hydrogenated product thereof, an alkylbenzene, an alkylnaphthalene, a diester, a polyol ester, a polyoxyalkylene glycol, a dialkyl diphenyl ether, a polyphenyl ether, or any mixture thereof.

2. The lubricating oil composition according to claim 1, the at least one additive comprising the component (B).

3. The lubricating oil composition according to claim 1, the component (C) comprising: (C1) a poly(meth)acrylate viscosity index improver in an amount of no less than 95 mass % on the basis of the total mass of the component (C), the component (C1) having a weight average molecular weight of no less than 100,000.

4. The lubricating oil composition according to claim 1, wherein the at least one additive does not comprise the component (C).

5. The lubricating oil composition according to claim 1, the at least one additive further comprising (D) a friction modifier, the component (D) comprising a molybdenum friction modifier.

6. The lubricating oil composition according to claim 1, wherein the lubricating base oil consists of at least one Group IV base oil of API base stock categories.

7. The lubricating oil composition according to claim 1, wherein the composition has a HTHS viscosity at 100° C. of 3.5 to 4.4 mPa·s.

8. The lubricating oil composition according to claim 1, wherein the composition has a NOACK evaporation loss at 250° C. of no more than 15 mass %.

9. The lubricating oil composition according to claim 1, wherein the at least one synthetic base oil is a poly α-olefin or a hydrogenated product thereof, an isobutene oligomer or a hydrogenated product thereof, a diester, a polyol ester, or any mixture thereof.

* * * * *